US011749490B2

(12) United States Patent
Ponard

(10) Patent No.: US 11,749,490 B2
(45) Date of Patent: Sep. 5, 2023

(54) METHOD FOR REDUCING THE DIAMETER OF A X-RAY TUBE THROUGH RECESSING OF THE VACUUM PORT

(71) Applicant: Pascal Ponard, Houston, TX (US)

(72) Inventor: Pascal Ponard, Houston, TX (US)

(73) Assignee: Visuray Intech Ltd (BVI), Tortola (VG)

( * ) Notice: Subject to any disclaimer, the term of this patent is extended or adjusted under 35 U.S.C. 154(b) by 105 days.

(21) Appl. No.: 17/518,130

(22) Filed: Nov. 3, 2021

(65) Prior Publication Data

US 2022/0238294 A1 Jul. 28, 2022

Related U.S. Application Data

(63) Continuation of application No. 17/177,879, filed on Feb. 17, 2021, now abandoned.

(60) Provisional application No. 62/977,514, filed on Feb. 17, 2020.

(51) Int. Cl.

| | |
|---|---|
| ***H01J 35/16*** | (2006.01) |
| ***H01J 35/20*** | (2006.01) |
| ***H01J 35/32*** | (2006.01) |

(52) U.S. Cl.
CPC ..... *H01J 35/16* (2013.01); *H01J 35/20* (2013.01); *H01J 35/32* (2013.01); *H01J 2235/163* (2013.01); *H01J 2235/164* (2013.01)

(58) Field of Classification Search
CPC .. H01J 35/16; H01J 35/20; H01J 35/32; H01J 2235/163; H01J 2235/164
See application file for complete search history.

(56) References Cited

U.S. PATENT DOCUMENTS

| | | | | |
|---|---|---|---|---|
| 3,700,950 | A * | 10/1972 | Michitaka | H01J 35/112 378/143 |
| 8,995,622 | B2 * | 3/2015 | Adler | H01J 35/153 378/118 |
| 2004/0165699 | A1 * | 8/2004 | Rusch | H01J 35/186 378/119 |
| 2016/0329185 | A1 * | 11/2016 | Miyaoka | H01J 35/28 |

* cited by examiner

*Primary Examiner* — Chih-Cheng Kao
(74) *Attorney, Agent, or Firm* — Adams and Reese LLP; Ray R. Ferrera

(57) ABSTRACT

Methods and means for reduced ng the overall diameter of an x-ray tube by recessing the vacuum pumping port stub within the ground plane of the x-ray tube without adversely affecting the electrostatic fields within the vacuum tube itself are provided. In one embodiment, x-ray tubes of smaller diameter, which can be used within the highly confined diameters typically found within the pressure housings of borehole tools are used.

1 Claim, 1 Drawing Sheet

METHOD FOR REDUCING THE DIAMETER OF A X-RAY TUBE THROUGH RECESSING OF THE VACUUM PORT

INTRODUCTION

The invention described herein consists of a method and means to reduce the overall diameter of an x-ray tube by recessing the vacuum pumping port stub within the ground plane of the x-ray tube without adversely affecting the electrostatic fields within the vacuum tube itself. The invention permits x-ray tubes of smaller diameter that can be used within the highly confined diameters typically found within the pressure housings of borehole tools.

BRIEF DESCRIPTION OF THE INVENTION

In one embodiment, a mid-plane ground is located between the anode and the cathode of an x-ray tube to create an azimuthally symmetric annular void outside of the vacuum volume that provides a toroidal recess the permits the vacuum port to be relocated within the outer diameter of the vacuum tube without any detrimental effect on the electrostatic field distributions with the tube. The mid-plane ground is shaped to permit additional focusing of the electron beam that is travelling between the cathode and the anode, while providing a zero-potential location for the vacuum port entry into the tube itself.

This effectively separates the positive potential electrostatic region and the negative potential electrostatic region into two lobes, with a very short ground-potential drift tube linking the two nodes.

As the electrons within the electron beam are already travelling at a significant proportion of the speed of light when they enter the drift-tube region, the beam-optics are not anticipated to be adversely affected.

Figure 1:
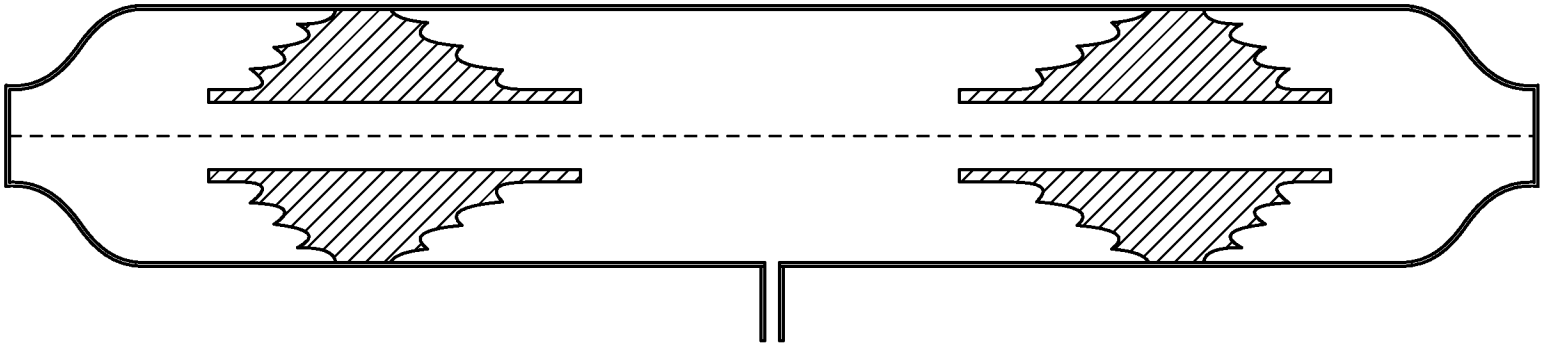

FIG. 1. In a typical x-ray vacuum tube, a vacuum port is required to connect the internal volume of the tube to a vacuum apparatus. In many tubes, once the tube has been sufficiently conditioned, the tube itself is camped (sealed) and disconnected, leaving a 'stump' which is at least as long as the diameter of the tube. So that the geometry of the vacuum port does not create discontinuities or inhomogeneities in the high electrostatic fields within the vacuum tube, the port is typically placed in a location of ground potential, or equipotential between the cathode and anode of the x-ray tube.

Figure 2:
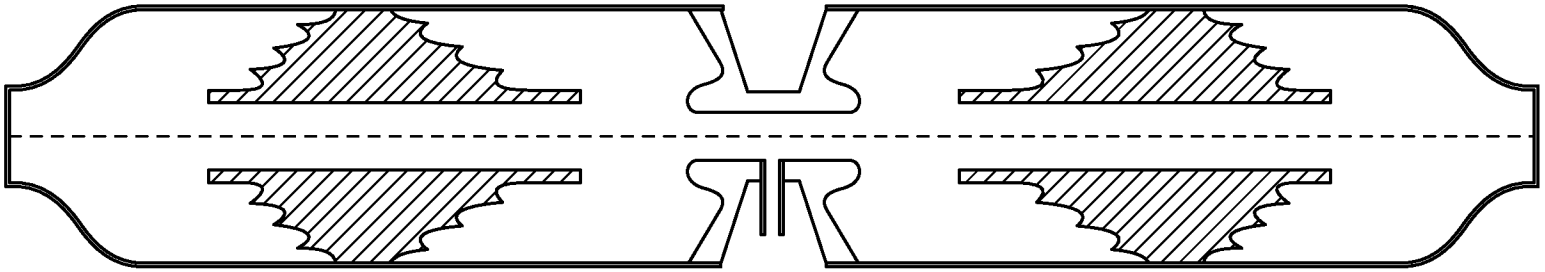

FIG. 2. The invention uses a mid-plane ground located between the anode and the cathode to create an azimuthally symmetric annular void outside of the vacuum volume that creates a toroidal recess the permits the vacuum port to be relocated within the outer diameter of the vacuum tube without any detrimental effect on the electrostatic field distributions with the tube.

BRIEF DESCRIPTION OF PRIOR ART OR CONVENTIONAL SOLUTIONS, IF KNOWN

In a typical x-ray vacuum tube, a vacuum port is required to connect the internal volume of the tube to a vacuum apparatus. In many tubes, once the tube has been sufficiently conditioned, the tube itself is crumped (sealed) and disconnected, leaving a 'stump' which is at least as long as the diameter of the tube. So that the geometry of the vacuum port does not create discontinuities or inhomogeneities in the high electrostatic fields within the vacuum tube, the port is typically placed in a location of ground potential, or equipotential between the cathode and anode of the x-ray tube.

In a mono-polar tube, where the target anode is typically at ground potential, the vacuum port is placed within the electrically grounded section of the tube, thereby not affecting the electrostatic fields within the accelerator portion of the x-ray tube. In a bi-polar tube, where the target anode is typically held at a high positive electrical potential, the vacuum port is typically placed at the mid-plane point between the high negative potential cathode and the high positive potential anode/target. However, the vacuum port creates a geometry that increases the overall diameter of the vacuum tube making it more challenging to fit within the narrow format of the grounded pressure housing of a borehole tool.

None of the prior art teaches of practical methods that can be employed to reduce the overall diameter of an x-ray tube by recessing the vacuum pumping port stub within the ground plane of the x-ray tube without adversely affecting the electrostatic fields within the vacuum tube itself.

U.S. Pat. No. 9,093,247 to Rogers et al discloses an x-ray tube including a casing having a cathode and an anode enclosed, and a separator attached to an inner wall of the casing and having a conductance limiter therein, the separator positioned to separate the anode from the cathode.

U.S. Pat. No. 8,995,622 to Adler et al discloses an x-ray source is wherein during operation of the x-ray source, an electron source emits a beam of electrons. The beam of electrons is focused to a spot on a target by a magnetic focusing lens. In response to receiving the beam of focused electrons, the target provides a transmission source of x-rays. A repositioning mechanism selectively repositions the beam of focused electrons to different locations on a surface of the target based on a feedback parameter associated with operation of the x-ray source. This feedback parameter may be based on: an intensity of the x-rays output by the x-ray source; a position of the x-rays output by the x-ray source; an elapsed time during operation of the x-ray source; a cross-sectional shape of the x-rays output by the x-ray source; and/or a spot size of the x-rays output by the x-ray source.

U.S. Pat. No. 8,126,118 to Hauttmann discloses an X-ray tube with a cathode, generating an electron beam, and an ion-deflecting and collecting setup, consisting of a single pair of electrodes, wherein the first electrode has a positive supply and the second electrode has either an actively or a passively generated negative voltage, compared to ground potential. Further, the invention relates to a method of voltage supplying of a deflecting and collecting setup consisting of a single pair of electrodes, wherein the first electrode has a positive voltage potential and the second electrode has either an actively or a passively generated negative voltage, compared to ground potential.

U.S. Pat. No. 8,090,075 to Holm et al discloses an X-ray tube, within which a cathode, that is held at negative high voltage during operating conditions, and an anode, which is held at positive high voltage during operating conditions, are disposed opposite each other in a vacuumized inner space, the anode being attached to an anode insulation element in such a way that the anode insulation element has a cylindrical shape or a shape tapering toward the anode and includes an opening to receive a high-voltage plug, and a pipe structure is provided by means of which a coolant is able to be supplied to the anode.

U.S. Pat. No. 7,949,099 to Klinkowstein et al discloses a bipolar x-ray tube. The bipolar x-ray tube includes two insulators that are separated by an intermediate electrode in an embodiment, wherein each insulator forms a portion of an outer wall of a vacuum envelope of the bipolar x-ray tube surrounding at least a portion of a path of an electron beam within the vacuum envelope U.S. Pat. No. 7,809,101 to Frutsehy et al discloses a modular x-ray source for an imaging system includes an electron source mounting plate, two or more electron sources each mounted on and electrically coupled to the electron source mounting plate, and a target block positioned proximately to the two or more electron sources. The source includes two or more targets mounted on and electrically coupled to the target block, each target positioned opposite a respective one of the two or more electron sources to receive a respective beam of electrons therefrom.

U.S. Pat. No. 7,564,948 to Wraight et, al discloses an x-ray source being used as a replacement for a chemical source during density logging along with various means of arranging the apparatus and associated power-supply, also teaches of the means of filtering the primary beam from the x-ray source such that a filtered dual-peak spectrum can be detected by a reference detector which is then used to directly control (feedback) the x-ray tube voltage and current for stability purposes. However, the patent only teaches a compact x-ray device (bipolar) with a grid, a power supply which is a cockroft Walton rolled up into a cylinder (between two Teflon cylinders) to save space, and the afore mentioned filtered reference detector method.

U.S. Pat. No. 8,481,919 to Teague teaches of the a means of creating and controlling the electrical power necessary, by serially stepping up the DC reference and creating high potential field control surfaces, to control either a bipolar or unipolar x-ray tube for the purposes of replacing chemical sources in reservoir logging. Also teaches of moveable/manipulable beam hardening filters and rotating light-house collimation on the source, the use of gaseous insulators inc SF6 as an electrical insulator in a downhole x-ray generator. However, it fails to teach of a method of using the increased output of the x-ray device to enable longer offset detectors to enable analysis of the non-invaded zone of the formation. It also fails to teach of a method to increase the permissible count rate within a detector volume by doubling the number of PMT; for a given detector volume.

Statement of Advantages of the Invention Over Prior Art

The invention described here has the following advantages/features:

A x-ray can be designed fit in a smaller diameter ground plane housing, as the vacuum port does not exceed the OD of the x-ray tube.

The invention claimed is:

1. A method for reducing the overall diameter of an x-ray tube, said method comprising recessing a vacuum pumping port stub within a ground plane of the x-ray tube without adversely affecting any electrostatic fields within the vacuum tube itself.

* * * * *